US009555270B2

(12) United States Patent
Goodman

(10) Patent No.: US 9,555,270 B2
(45) Date of Patent: Jan. 31, 2017

(54) SAFETY GLASS BREAKER

(71) Applicant: Larry Goodman, Cerritos, CA (US)

(72) Inventor: Larry Goodman, Cerritos, CA (US)

( * ) Notice: Subject to any disclaimer, the term of this patent is extended or adjusted under 35 U.S.C. 154(b) by 0 days.

(21) Appl. No.: 14/922,715

(22) Filed: Oct. 26, 2015

(65) Prior Publication Data

US 2016/0346569 A1 Dec. 1, 2016

Related U.S. Application Data

(63) Continuation-in-part of application No. 14/725,511, filed on May 29, 2015, now Pat. No. 9,375,589.

(51) Int. Cl.
*A62B 3/00* (2006.01)

(52) U.S. Cl.
CPC ..... *A62B 3/005* (2013.01); *Y10S 30/04* (2013.01); *Y10T 225/371* (2015.04)

(58) Field of Classification Search
CPC ..... A62B 3/005; Y10T 30/04; Y10T 83/8863; Y10T 225/371; Y10T 29/53839; Y10S 60/914; B21D 28/007; B25B 21/023; B25B 27/0085
USPC ..... 30/367, 277, DIG. 4, 164.6, 358–368; 227/10; 604/69; 42/70.08; 225/103; 102/502
See application file for complete search history.

(56) References Cited

U.S. PATENT DOCUMENTS

| | | | | |
|---|---|---|---|---|
| 1,663,834 | A | 3/1928 | Goss | |
| 1,664,049 | A * | 3/1928 | Sedgley | F41C 9/02 42/1.09 |
| 3,074,165 | A | 1/1963 | Davis | |
| 3,315,397 | A | 4/1967 | Gilliam | |
| 3,956,843 | A | 5/1976 | Litman | |
| 4,757,628 | A | 7/1988 | Bulfer | |
| 5,062,230 | A | 11/1991 | Braverman | |
| 1,897,992 | A | 2/1993 | Ailes | |
| 6,418,628 | B1 | 7/2002 | Steingass | |
| 7,557,720 | B2 | 7/2009 | Rubin et al. | |
| 8,727,060 | B1 | 5/2014 | Erickson | |
| 2004/0050607 | A1 | 3/2004 | Souther | |
| 2010/0317247 | A1 | 12/2010 | McGlynn | |
| 2013/0227795 | A1 | 9/2013 | Franken | |
| 2015/0033477 | A1 | 2/2015 | Rubin et al. | |

* cited by examiner

*Primary Examiner* — Laura M Lee
(74) *Attorney, Agent, or Firm* — Kenneth L. Green; Averill & Green

(57) ABSTRACT

An automobile safety glass breaker tool is held against an automobile safety glass window and fired to break the window. The tool is armed by sliding a firing pin piston to the rear against a spring and fired by releasing the firing pin piston. The firing pin piston hits a 0.22 blank cartridge to fire the blank cartridge. The blank cartridge drives a striker piston forward, and a striker point on the striker piston impacts and shatters the automobile safety glass window. The striker point is limited to reach about 0.06 inches forward and out of the tool to prevent injury to a user.

18 Claims, 3 Drawing Sheets

SAFETY GLASS BREAKER

CROSS-REFERENCE TO RELATED APPLICATIONS

The present application is a Continuation In Part of U.S. patent application Ser. No. 14/725,511 filed May 29, 2015, which application is incorporated in its entirety herein by reference.

BACKGROUND OF THE INVENTION

The present invention relates to controlled breaking of glass and in particular to a tool for breaking automobile safety glass windows.

Automobiles involved in traffic accidents often are damaged to the extent that the occupants cannot easily escape the automobile. When there is a fire or risk of a fire, or the automobile is submerged or becoming submerged, or there is a risk of the automobile sliding down a slope, a rapid escape by the occupants is very important.

Various tools are known for breaking automobile window glass to allow escape. U.S. Pat. No. 6,418,628 issued Jul. 16, 2002 discloses a spring actuated tool for fire fighters and emergency personnel for breaking automobile glass. Unfortunately, such spring actuated tools do not always break the glass, and over time, the springs may weaken. Other similar tools do not always provide the necessary result.

BRIEF SUMMARY OF THE INVENTION

The present invention addresses the above and other needs by providing an automobile safety glass breaker tool which is held against an automobile safety glass window and fired to break the window. The tool is armed by sliding a firing pin piston to the rear against a spring and fired by releasing the firing pin piston. The firing pin piston hits a 0.22 blank cartridge to fire the blank cartridge. The blank cartridge drives a striker piston forward, and a striker point on the striker piston impacts and shatters the automobile safety glass window. The striker point is limited to reach about 0.06 inches forward and out of the tool to prevent injury to a user.

In accordance with one aspect of the invention, there is provided a 22 blank cartridge actuated automobile safety glass breaker tool. Known tools are spring actuated and limited by the impact force of the spring. The springs often do not provide a sufficient impact to shatter automobile safety glass. The 0.22 blank cartridge actuated automobile safety glass breaker tool is easy to use and consistently shatters automobile safety glass.

In accordance with another aspect of the invention, there is provided a very short travel automobile safety glass breaker tool. The expanding gasses provided by the 22 blank cartridge drives the striker point quickly and firmly against the glass. A preferred striker point travel of 0.060 inches reduces or eliminates the possibility of injury should the tool be fired against a human.

In accordance with yet another aspect of the invention, there is provided a very short travel automobile safety glass breaker tool having an exposed striker point. The exposed striker point is held against a safety glass window and does not require precise alignment. The expanding gasses provided by the 22 blank cartridge drives the striker point quickly and firmly against the glass. A preferred travel of 0.040 inches reduces or eliminates the possibility of injury should the tool be fired against a human.

In accordance with still another aspect of the invention, there is provided an automobile safety glass breaker tool having a hollow piston for firing a blank cartridge. The piston must travel forward to strike the blank cartridge to fire the tool. The hollow piston is required to operate the tool under water.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
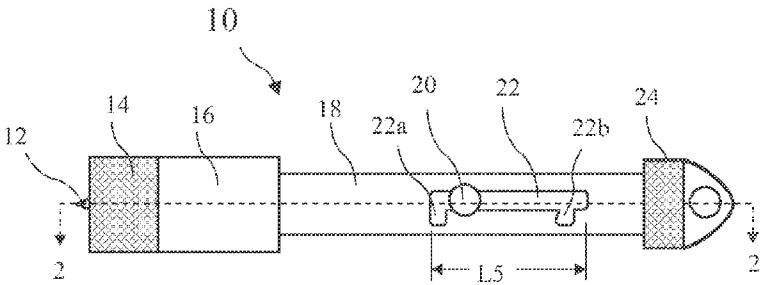
FIG. 1 is a side view of an automobile safety glass breaker tool according to the present invention.

A side view of an automobile safety glass breaker tool 10 according to the present invention is shown in FIG. 1. The tool 10 includes a striker 12, a striker housing cap 14, a striker housing 16, a firing pin piston housing 18 providing a handle for the tool 10, a trigger 20, a longitudinally extending trigger slot 22, and a trigger housing cap 24. The trigger slot 22 includes a first angular recess 22*a* at an end nearest to the striker 12, and a second angular recess 22*b* farthest from the striker 12. The second angular recess 22*b* is sloped axially towards the striker 12 providing a cocked position for the trigger 20. The trigger slot 22 has an overall length L5 of preferably 0.9 inches. Elements for the tool 10 are generally cylindrical with a round cross-section, except for the trigger 20, the trigger slot 22, and the firing pin 29.

Figure 2:
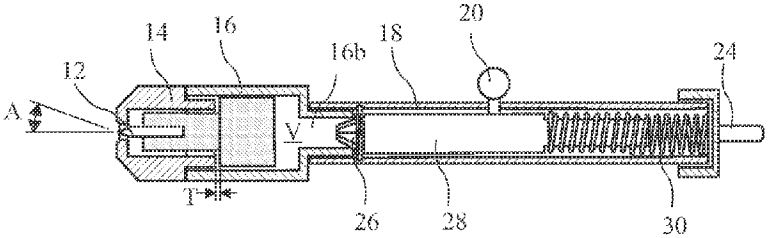
FIG. 2 is a cross-sectional view of the automobile safety glass breaker tool according to the present invention taken along line 2-2 of FIG. 1.
Figure 3:
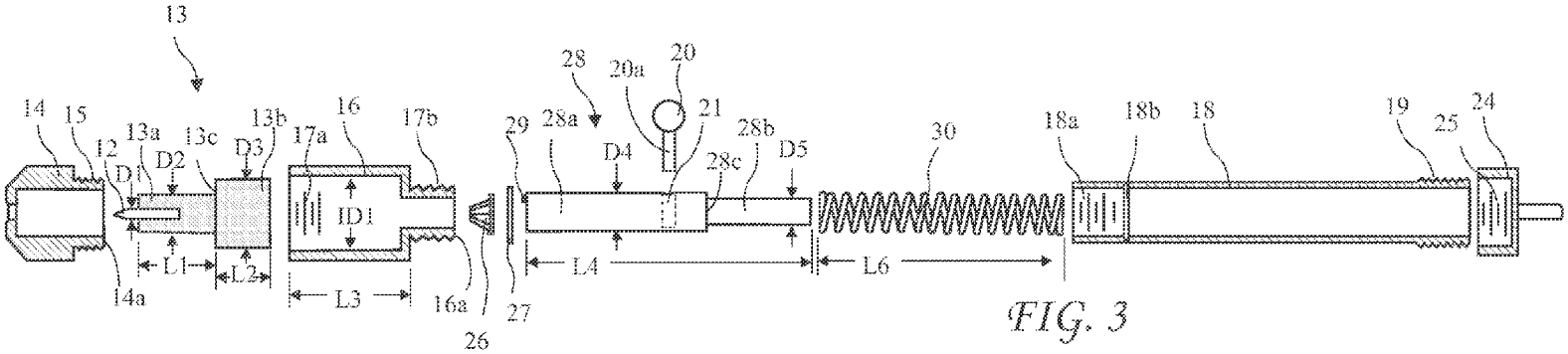
FIG. 3 is an exploded cross-sectional view of the automobile safety glass breaker tool according to the present invention taken along line 2-2 of FIG. 1.

A cross-sectional view of the tool 10 taken along line 2-2 of FIG. 1 is shown in FIG. 2 and an exploded cross-sectional view of the tool 10 taken along line 2-2 of FIG. 1 is shown in FIG. 3. The striker 12 is attached (preferably a press or interference fit) to a striker piston 13 including a first diameter cylindrical portion 13*a* and a second diameter cylindrical portion 13*b*, separated by a step 13*c*. The first cylindrical portion 13*a* has a length L1 of preferably 0.6 inches and a diameter D2 of preferably 0.25 inches. The second cylindrical portion 13*b* has a length L2 of preferably 0.4 inches and a diameter D3 of preferably 0.38 inches. The striker 12 is preferably a very hard material, for example, tungsten carbide or the like, and is preferably embedded in the striker piston 13 and has a diameter D1 of preferably ⅛ inches and a half angle A preferably between 30 degrees and 45 degrees, and more preferably 45 degrees. The second cylindrical portion 13*b* sides inside the striker housing 16 having an inside diameter ID1 of preferably 0.385 inches. The striker piston 13 is preferably an oil impregnated bronze material (e.g., oilite) or the like providing smooth sliding in the striker housing 16.

The striker housing cap 14 includes male threads 15 engaging female threads 17*a* in the striker housing 16. The striker housing cap 14 includes a striker stop surface 14*a* facing the step 13*c* and limiting forward motion of the striker 12 to a travel T of preferably between 0.02 inches and 0.06 inches, and more preferably 0.06 inches. In general, the travel T is not more than 0.06 inches to avoid possible injury to a user.

The striker housing 16 further includes a rear reaching male threaded portion 17*b* threading into female threads 18*a* of the firing pin piston housing 18. The threaded portion 17*b* and 18*a* are preferably a ⅜ inch thread. The firing pin piston housing 18 includes a clip 27 residing in a groove 18*b* recessed past the threads 18*a*. When the piston housing is fully threaded onto the threaded portion 17*b*, the clip 27 holds a blank cartridge 26 against a rear facing blank cartridge stop surface 16*a* of the striker housing 16. The blank cartridge 26 is preferably a 22 blank cartridge, for example, a WALTHER 6 mm flobert blank cartridge. Alternatively, a step may be formed in the firing pin piston housing 18 to sandwich the blank cartridge 26. The striker piston housing 16 and blank cartridge 26 form a closed striker housing chamber 16*b* for capturing pressure created by firing the blank cartridge 26 to drive the striker piston 13 forward. The striker housing chamber 16*b* has a volume V of preferably between 0.16 cubic inches and 0.04 cubic inches, and preferably 0.08 cubic inches. The clip 27 may be replaced by an internal forward facing step in the piston housing 18.

A piston 28 slides in the firing pin piston housing 18. The piston 18 includes a firing pin 29 on a front facing surface for firing the blank cartridge 26. The blank cartridge 26 is preferably a rim fire blank cartridge and the pin 29 is offset. Alternatively, a centerfire blank cartridge may be used with a centered pin. The piston 28 has a length L4 of preferably 1.5 inches and includes a front portion 28*a* having a diameter D4 of preferably 0.312 inches and a rear portion 28*b* having a diameter D5 of preferably 0.215 inches. A step 28*c* separates the portions 28*a* and 28*b*. A spring 30 resided over the rear portion 28*b* and is held between the step 28*c* and the trigger housing cap 24 providing forward force on the piston 28. The spring 30 preferably has a spring rate between four and twelve pounds per inch, and more preferably eight pounds per inch, and has a free length L6 of preferably between 1.5 and 2.5 inches and more preferably two inches. The trigger 20 includes a shaft 20*a* engaging a hole 21 in the piston 28. The shaft 20*a* passes through the firing pin piston housing 18 allowing actuation of the trigger 20 to cock the tool 10 and to fire the tool 10. The trigger housing cap 24 includes female threads 25 engaging male threads 19 on the firing pin piston housing 18.

Figure 4:
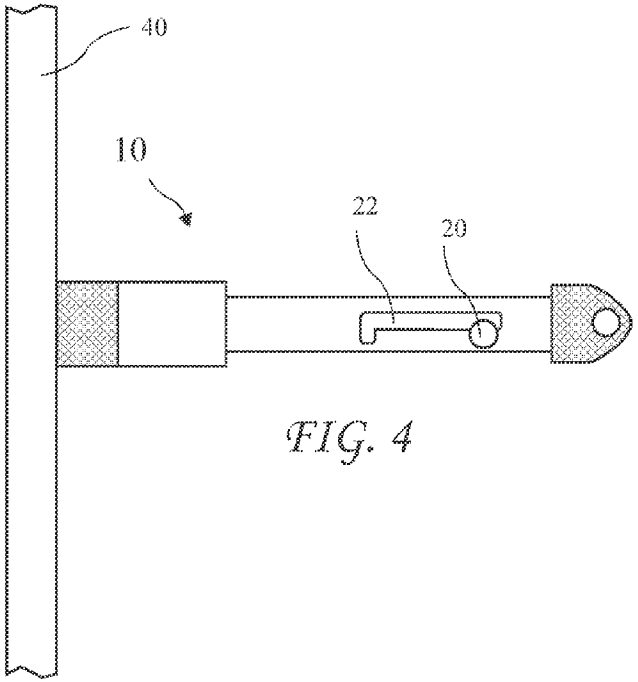
FIG. 4 shows the automobile safety glass breaker tool according to the present invention pressed against a safety glass window ready for use.
Figure 4A:
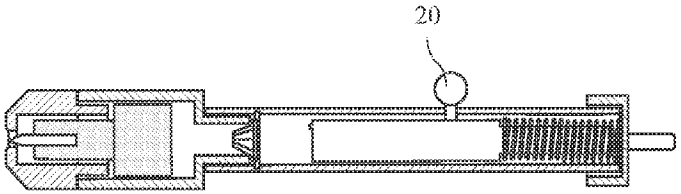
FIG. 4A shows a cross-sectional view of the automobile safety glass breaker tool according to the present invention ready for use.

FIG. 4 shows the tool 10 pressed against a safety glass window 40 ready for use and FIG. 4A shows a cross-sectional view of the tool 10 ready for use. The trigger 20 is drawn to the rear of the slot 22 and may be caught in the second recess 22*b* or held to the rear.

Figure 5:
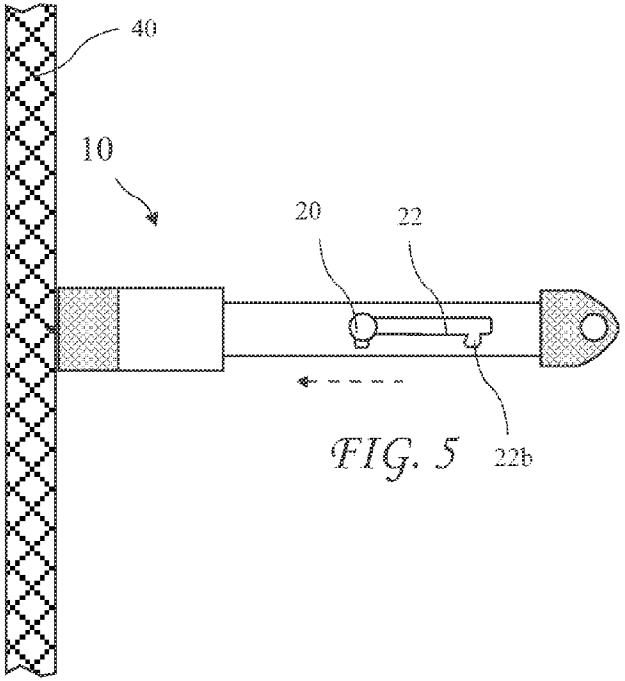
FIG. 5 shows the automobile safety glass breaker tool according to the present invention pressed against a shattered safety glass window after use.
Figure 5A:
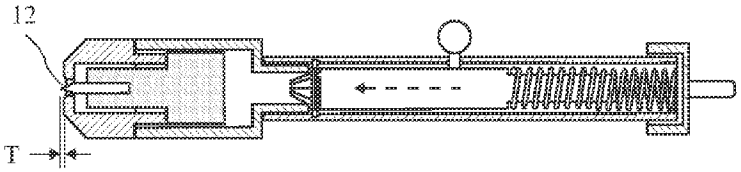
FIG. 5A shows a cross-sectional view of the automobile safety glass breaker tool according to the present invention after use.

FIG. 5 shows the tool 10 pressed against a shattered safety glass window 40 after use and FIG. 5A shows a cross-sectional view of the tool 10 after use. The striker 12 is limited to the travel T to prevent injury to a user.

Figure 6:
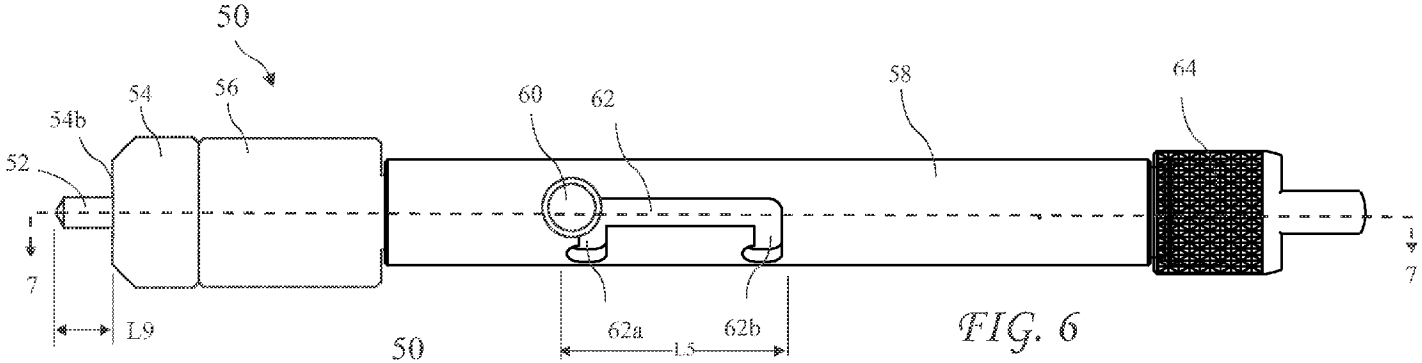
FIG. 6 shows a side view of a second automobile safety glass breaker tool according to the present invention.

A side view of a second automobile safety glass breaker tool 50 according to the present invention is shown in FIG. 6. The tool 50 includes an exposed striker 52, a striker housing cap 54, a striker housing 56, a firing pin piston housing 58 providing a handle for the tool 50, a trigger 60, a longitudinally extending trigger slot 62, and a trigger housing cap 64. The trigger slot 62 includes a first angular recess 62*a* at an end nearest to the striker 52, and a second angular recess 62*b* farthest from the striker 52. The second angular recess 62*b* is sloped axially towards the striker 52 providing a cocked position for the trigger 60. The trigger slot 62 has an overall length L5 of about one inch. Elements for the tool 50 are generally cylindrical with a round cross-section, except for the trigger 60, the trigger slot 62, and the firing pin 69. The striker 52 extends out of the striker housing cap an exposed length L9 of preferably between 0.1 and 0.5 inches, and m ore preferably between 0.2 inches and 0.5 inches and most preferably about 0.2 inches.

Figure 7:
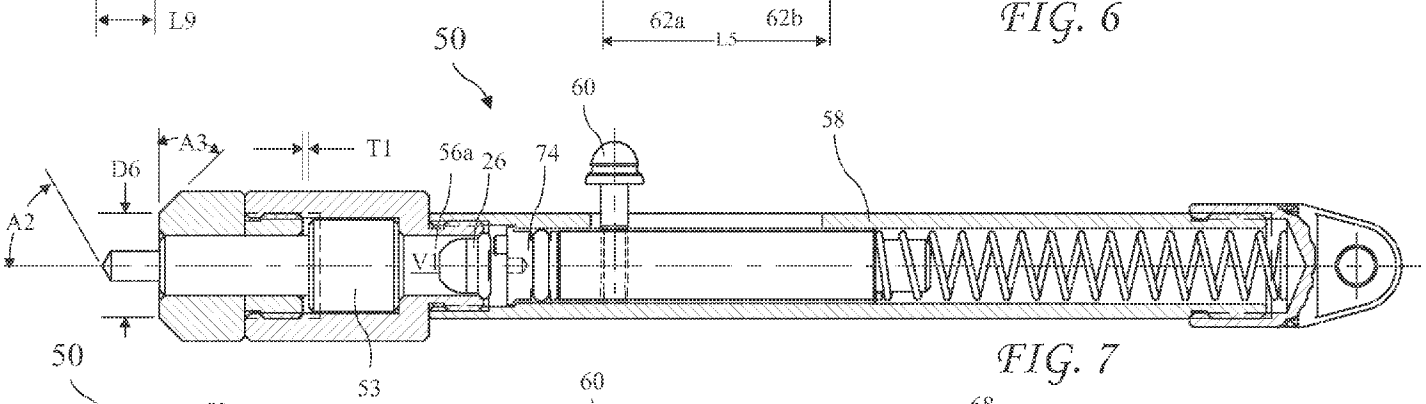
FIG. 7 shows a cross-sectional view of the second automobile safety glass breaker tool according to the present invention taken along line 7-7 of FIG. 6.
Figure 8:
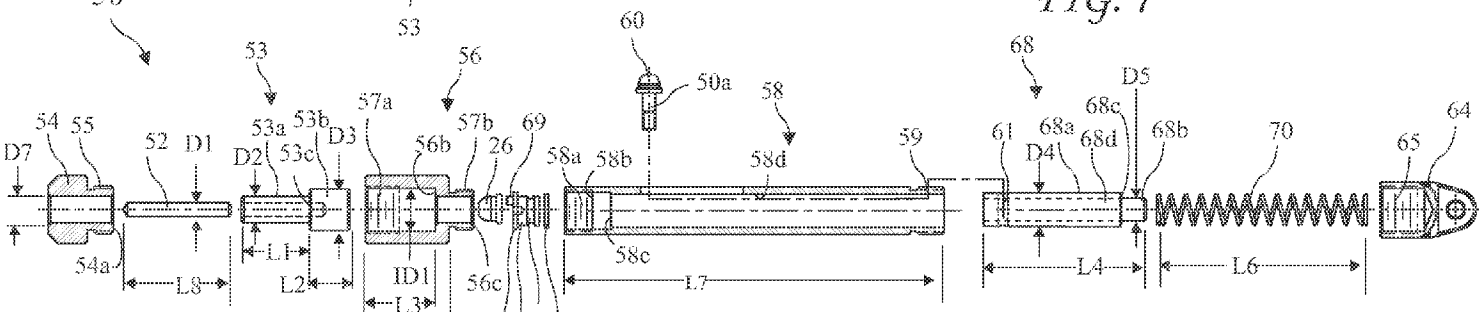
FIG. 8 shows an exploded view of the second automobile safety glass breaker tool according to the present invention.

A cross-sectional view of the tool 50 taken along line 7-7 of FIG. 6 is shown in FIG. 7 and an exploded cross-sectional view of the tool 50 taken along line 7-7 of FIG. 6 is shown in FIG. 8. The striker 52 is attached (preferably a press or interference fit) to a striker piston 53 including a first diameter cylindrical portion 53*a* and a second diameter cylindrical portion 53*b*, separated by a forward facing step 53*c*. The first cylindrical portion 53*a* has a length L1 of preferably about 0.62 inches and a diameter D2 of preferably about 0.25 inches. The second cylindrical portion 53*b* has a length L2 of preferably about 0.376 inches and a diameter D3 of preferably 0.38 inches.

The striker 52 is preferably a very hard material, for example, tungsten carbide or the like, and is preferably embedded in the striker piston 53 and has a diameter D1 of preferably about ⅛ inches, a length L8 of preferably about 0.99 inches. The striker 52 is preferably pointed having a half angle A2 preferably between 30 degrees and 70 degrees, and more preferably between 60 degrees and 67.5 degrees, and most preferably 60 degrees. The second cylindrical portion 53*b* sides into an interior of the striker housing 56 having an inside diameter ID1 of preferably about 0.395 inches, depth DP of preferably about 0.64 inches, and a forward facing rearward striker stop surface 56*b* limiting rearward travel of the striker piston 53. The striker piston 53 is preferably an oil impregnated bronze material (e.g., oilite) or the like providing smooth sliding in the striker housing 56.

The striker housing cap 54 includes male threads 55 engaging female threads 57*a* in the striker housing 56 to form a striker housing assembly. The striker housing cap 54 includes a forward striker stop surface 54*a* facing the step 53*c* of the striker piston 53. The cooperation of the forward striker stop surface 54*a* and the rearward striker stop surface 56*b* with the second diameter cylindrical portion 53*b* of the striker piston 53, determines the travel T1 of the striker piston 53, limiting motion of the striker 52 to the travel T1 of preferably between 0.03 inches and 0.1 inches, and m ore preferably between 0.04 inches and 0.08 inches, and most preferably 0.04 inches. In general, the travel T1 is not more than 0.06 inches to avoid possible injury to a user. A nose 54*b* of the striker housing cap 54 includes a flat portion having a diameter D6 of preferably between ⅜ inches and ½ inches, and more preferable about 0.44 inches, surrounded by a conical tapered portion, preferably tapered at about 45 degrees.

The striker housing 56 further includes a rear reaching male threaded portion 57*b* threading into female threads 58*a* of the firing pin piston housing 58. The threaded portion 57*b* and 58*a* are preferably a ⅜-24 thread. The firing pin piston housing 58 includes a housing interior 58*d* including forward first facing step 58*b* residing recessed past the threads 58*a* and a second forward facing step 58*c* residing past the step 58*b*. When the piston housing is fully threaded onto the threaded portion 57*b*, the step 58*b* holds a blank cartridge 26 against a rear facing blank cartridge stop surface 56*c* of the striker housing 56. The blank cartridge 26 is preferably a 22 blank cartridge, for example, a Walther 6 mm flobert blank cartridge. The striker piston housing 56 and blank cartridge 26 form a closed striker housing chamber 56*a* for capturing pressure created by firing the blank cartridge 26 to drive the striker piston 53 forward. The striker housing chamber 56*a* has a volume V1 of preferably between 0.004 cubic inches and 0.008 cubic inches, and preferably 0.006 cubic inches. The piston housing 58 has a length L7 of preferably about 3.5 inches. The striker housing chamber 56*a* is substantially closed, only allowing negligible gases to escape forward between the striker piston 53 and striker housing cap 54, thus avoiding injury to a user firing the tool 50.

A firing piston 68 slides in the firing pin piston housing 58. The firing piston 68 has an overall length L4 of preferably 1.6 inches and includes a front portion 68*a* having a diameter D4 of preferably 0.25 inches and a rear portion 68*b* having a diameter D5 of preferably 0.165 inches. A through passage 68*d* has an inside diameter of preferably 0.125 inches and allows the firing piston 68 to move forward when the tool 50 is used under water. A step 68*c* separates the portions 68*a* and 68*b*. The trigger 60 includes a shaft 50*a* engaging a hole 61 in the piston 68. The shaft 60*a* passes through the firing pin piston housing 58 allowing actuation of the trigger 60 to cock the tool 50 and to fire the tool 50. The trigger housing cap 64 includes female threads 65 engaging male threads 59 on the firing pin piston housing 58.

A spring 70 resided over the rear portion 68*b* of the firing piston 68 and is held between the step 68*c* and the trigger housing cap 54 providing forward force on the firing piston 68. The spring 70 is preferably made from 0.03 inches diameter music wire and has a spring rate of preferably between four and six pounds per inch and more preferably five pounds per inch, and has a free length L6 of preferably between two and three inches and more preferably 2.5 inches. Spring 70 has an outside diameter of preferably about 0.234 inches and an inside diameter of preferably about 0.174 inches.

The firing piston 68 pushed a firing pin piston 72 forward to fire the blank cartridge 26. The firing pin piston 72 resides in the firing piston housing. The blank cartridge 26 is preferably a rim fire blank cartridge and the pin 69 is preferably offset. Alternatively, a centerfire blank cartridge may be used with a centered pin. The firing pin piston 72 includes a firing pin 69 and concentric centering ring 73 on a forward face, and an O-Ring groove 74. The concentric centering ring 73 has a diameter of preferably 0.325 inches. An O-Ring 75 fits into the O-ring groove 74. The concentric centering ring 73 resides between the blank 26 and the step 58*c* and the O-Ring 75 resides behind the step 58*c*.

While the invention herein disclosed has been described by means of specific embodiments and applications thereof, numerous modifications and variations could be made thereto by those skilled in the art without departing from the scope of the invention set forth in the claims.

I claim:

1. A window breaking tool, comprising:

a striker piston housing assembly including a striker housing cap attached to a striker housing, the striker housing cap including a rearward facing striker housing stop surface in an interior of the striker piston housing assembly;

a handle extending back from the striker piston housing assembly;

a striker piston sliding in the striker piston housing assembly, the striker piston including:

a first cylindrical portion sliding axially in the striker housing cap;

a second cylindrical portion sliding axially in the striker housing, the second cylindrical portion having a larger diameter than the first cylindrical portion; and a forward facing striker piston stop surface between the first cylindrical portion and the second cylindrical portion, the striker piston stop surface including a step axially aligned with the striker housing stop surface to terminate forward movement of the striker piston by contact of the striker piston stop surface with the striker housing stop surface;

a striker extending forward from the striker piston, at least 0.02 inches of the striker exposed when the striker piston stop surface resides against the striker housing stop surface;

a blank cartridge stop configured to position a blank cartridge in a blank cartridge position between the striker piston housing assembly and the handle, the blank cartridge facing the striker piston;

a striker chamber between the blank cartridge position and the striker piston; and a firing pin configured to strike the blank cartridge to fire the blank cartridge to create pressure in the striker chamber to propel the striker piston carrying the striker forward.

2. The tool of claim 1, wherein the striker piston travel is limited to between 0.02 and 0.06 inches.

3. The tool of claim 2, wherein the striker piston travel is not greater than 0.040 inches.

4. The tool of claim 2, wherein the striker piston travel is about 0.04 inches.

5. The tool of claim 1, wherein the handle is a firing pin piston housing, the tool further including:

a firing piston sliding axially in the firing pin piston housing;

the firing pin urged forward by the firing piston and aligned to fire the blank cartridge;

a trigger attached to firing piston and extending out through a longitudinal slot in the firing pin piston housing; and a spring applying forward force against the firing piston towards the blank cartridge position.

6. The tool of claim 5, wherein the spring has free length between 2 and 3 inches and a spring rate between four and six pounds per inch.

7. The tool of claim 5, wherein the firing pin is an offset fixed firing pin configured to fire a rim fire blank cartridge.

8. The tool of claim 5, further including a firing pin piston held separable from the firing piston in a forward end of the firing pin piston housing between the striker piston housing assembly and a forward facing step in the firing pin piston housing proximal to the forward end of the firing pin piston housing between the firing piston and the blank cartridge position, the firing pin residing on a forward face of the firing pin piston.

9. The tool of claim 8, wherein the firing pin piston includes a concentric ring on a forward face of the firing pin piston, the concentric centering ring cooperating with a forward facing step in the firing pin piston housing interior retaining the firing pin piston at a forward end of the firing pin piston housing, and limiting the firing pin piston movement towards the rear of the firing pin piston housing.

10. The tool of claim 9, wherein:

the firing pin piston includes an O-Ring groove behind the concentric centering ring; and an O-Ring residing in the O-Ring groove and resides against an interior of the firing pin piston housing.

11. The tool of claim 1, wherein the striker has a pointed tip.

12. The tool of claim 11, wherein the pointed tip of the striker has a half angle between 60 degrees and 67.5 degrees.

13. The tool of claim 1, wherein the striker has an exposed length (L9) between 0.02 and 0.06 inches when the striker piston resides against the rearward striker stop surface.

14. The tool of claim 1, wherein the striker chamber is substantially closed when the striker chamber contains the blank cartridge in the blank cartridge position, allowing gases to escape from the striker chamber when the tool is fired.

15. The tool of claim 1, wherein the striker is made from tungsten carbide.

16. The tool of claim 1, wherein the striker is about ⅛ inches in diameter.

17. A window breaking tool, comprising:

a striker piston housing assembly including a striker housing cap attached to a striker housing, the striker housing cap including a rearward facing striker housing stop surface in an interior of the striker piston housing assembly;

a firing pin piston housing extending back from the striker piston housing assembly;

a striker piston sliding axially in the striker piston housing assembly, the striker piston including;

a first cylindrical portion sliding axially in the striker housing cap;

a second cylindrical portion sliding axially in the striker housing, the second cylindrical portion having a larger diameter than the first cylindrical portion; and a forward facing striker piston stop surface between the first cylindrical portion and the second cylindrical portion, the striker piston stop surface including a step axially aligned with the striker housing stop surface, striker piston forward travel limited by contact of the striker piston stop surface with the striker housing stop surface;

a striker extending forward from the striker piston, the striker having a pointed tip;

forward travel of the striker piston out of the tool limited to between 0.02 and 0.06 inches by contact of the striker piston stop surface with the striker housing stop surface;

a blank cartridge stop configured to position a blank cartridge facing the striker piston and residing between the striker piston housing assembly and the firing pin piston housing;

a substantially closed striker chamber when the striker chamber contains the blank cartridge in the blank cartridge position, allowing gases to escape from the striker chamber when the tool is fired;

a firing piston sliding in the firing pin piston housing;

a firing pin piston residing in the firing pin piston housing between the firing piston and the cartridge position;

a firing pin piston residing ahead of the firing piston in the firing pin piston housing, the firing pin piston including a concentric centering ring on a forward face of the firing pin piston, the concentric centering ring cooperating with a forward facing step in the firing pin piston housing interior retaining the firing pin piston at a forward end of the firing pin piston housing and limiting the firing pin piston movement towards the rear of the firing pin piston housing;

a fixed firing pin on a forward face of the firing pin piston aligned to fire the blank cartridge to create pressure in the closed striker chamber to propel the striker piston carrying the striker forward;

a trigger attached to the firing piston and extending out through the firing pin piston housing to pull the firing piston to a rear position; and a spring applying forward force against the firing piston towards the firing pin piston.

18. A window breaking tool, comprising:

a striker piston housing assembly including a striker housing cap attached to a striker housing, the striker housing cap including a rearward facing striker housing stop surface in an interior of the striker piston housing assembly;

a firing pin piston housing extending back from the striker piston housing assembly;

a striker piston sliding axially in the striker piston housing, the striker piston including:

a first cylindrical portion sliding axially in the striker housing cap;

a second cylindrical portion sliding axially in the striker housing, the second cylindrical portion having a larger diameter than the first cylindrical portion; and a forward facing striker piston stop surface between the first cylindrical portion and the second cylindrical portion, the striker piston stop surface including a step axially aligned with the striker housing stop surface to limit forward movement of the striker piston;

a striker extending forward from the striker piston, the striker having a pointed tip, the striker having an exposed length (L9) not greater than 0.06 inches when the striker piston stop surface resides against the striker housing stop surface;

a blank cartridge stop configured to position a blank cartridge facing the striker piston and residing between the striker piston housing and the firing pin piston housing;

a closed striker chamber between the blank cartridge stop and the striker piston, the striker chamber substantially closed when the striker chamber contains the blank cartridge in the blank cartridge position, allowing gases to escape from the striker chamber when the tool is fired;

a hollow firing piston sliding in the firing pin piston housing;

a firing pin piston sliding in the firing pin piston housing ahead of the firing piston, the firing pin piston retained to reside in a forward end of the firing pin piston housing;

a fixed firing pin on a forward face of the firing pin piston aligned to fire the blank cartridge to create pressure in the closed striker chamber to propel the striker piston carrying the striker forward;

a trigger attached to the firing piston to pull the firing pin piston to a rear position;

the trigger reaching out of the firing pin housing through a longitudinal slot in the firing pin piston housing; and a spring having a free length of between two and three inches and a spring rate between four and six pounds per inch and applying forward force against the firing piston towards the firing pin piston.

* * * * *